United States Patent [19]

Eskeli

[11] 3,933,007

[45] Jan. 20, 1976

[54] COMPRESSING CENTRIFUGE

[76] Inventor: Michael Eskeli, 7994-41 Locke Lee, Houston, Tex. 77042

[22] Filed: Oct. 11, 1973

[21] Appl. No.: 405,584

[52] U.S. Cl. ..... 62/401; 126/247; 165/86; 415/1; 415/64; 415/178; 416/96

[51] Int. Cl. ..... F25b 3/00

[58] Field of Search ..... 62/86, 87, 401, 402, 499; 122/26; 126/247; 165/86, 88; 415/1, 64, 114, 177, 178, 179, 199 A; 416/95, 96

[56] References Cited

UNITED STATES PATENTS

| | | | |
|---|---|---|---|
| 1,183,939 | 5/1916 | Whittelsey | 122/26 |
| 2,522,781 | 9/1950 | Exner | 62/499 |
| 2,529,765 | 11/1950 | Exner | 62/499 |

FOREIGN PATENTS OR APPLICATIONS

| | | | |
|---|---|---|---|
| 633,985 | 6/1937 | Germany | 62/401 |

*Primary Examiner*—Albert W. Davis, Jr.
*Assistant Examiner*—Sheldon Richter
*Attorney, Agent, or Firm*—Robert W. Dickerson

[57] ABSTRACT

A method and apparatus for compressing fluid by passing said fluid through a rotating continuous flow centrifuge wherein said fluid is pressurized by centrifugal action on said fluid by said centrifuge rotor. Said rotor is provided with passageways for said fluid with vanes placed therewithin for assuring that the fluid will rotate with said rotor. After compressing occurs, said fluid is passed in compressed state to a second rotor wherein energy contained in said fluid is converted to work, with said fluid being passed within fluid passageways in said second rotor inwardly to an exit at center, with vanes ensuring that said fluid second rotor will rotate with said fluid for receiving the work associated with deceleration of said fluid. Cooling may be provided during compression of said fluid by circulating a coolant in heat exchange relationship with said fluid. Nozzles may be provided near the first rotor periphery for decelerating said first fluid. Fluids being compressed may be gases or gases with minor amounts of liquid, such as air, or halogenated hydrocarbons.

7 Claims, 3 Drawing Figures

COMPRESSING CENTRIFUGE

CROSS REFERENCES TO RELATED APPLICATIONS

This application is similar to my U.S. Pat. No. 3,761,195, and 3,793,848 with some additions and improvements. (Compressing Centrifuge)

Also, similar principles were used in patent application "Compressing Centrifuge with Cooling", Ser. No. 243,239, filed 4/12/72.

BACKGROUND OF THE INVENTION

This invention relates to devices for compressing gases from a lower pressure to a higher pressure by employing a continuous flow centrifuge as the compressing first rotor and using an inward flow turbine as the second rotor wherein energy contained in the fluid leaving said first rotor is converted to work.

In my previous U.S. Pat. No. 3,761,195, I described a similar compressor to the compressor of this invention; the device of this invention adds some improvements and changes to said previously patented compressor.

DESCRIPTION OF PREFERRED EMBODIMENTS

It is an object of this invention to provide for partial reduction in the absolute tangential velocity of the working fluid by providing nozzles oriented backward near the periphery of said a first rotor through which nozzles said working fluid will pass to a second rotor. Further, it is an object of this invention to provide a cooling heat exchanger within said first rotor to remove heat of compression either fully or in part. It is also an object of this invention to provide a casing around said rotors to allow evacuation of said casing thus reducing fluid friction on said rotor external surfaces.

Figure 1:
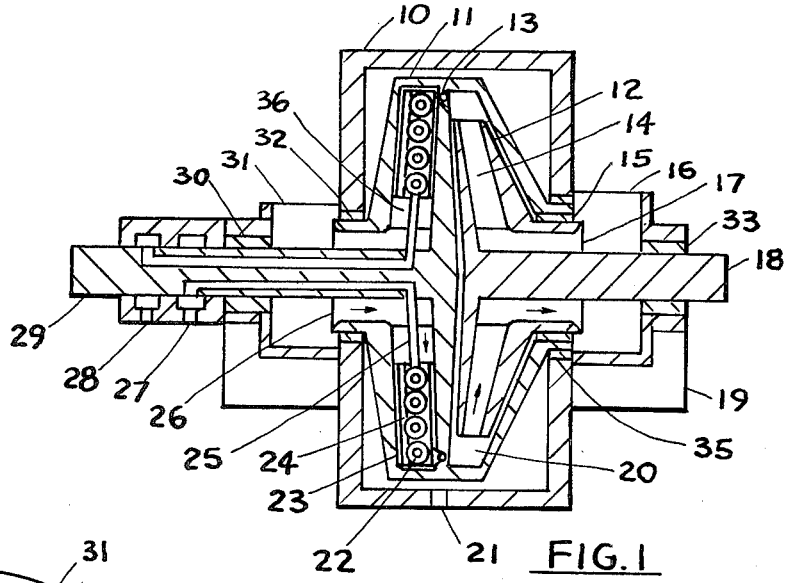
FIG. 1 is a cross section of the compressor.

Referring to FIG. 1, therein is shown a cross section of the compressor. 10 is casing, 11 is first rotor, 12 is second rotor, 13 are first rotor exit nozzles, 14 are second rotor vanes, 15 is rotor seal, 16 is working fluid exit from unit, 17 is working fluid exit from second rotor, 33 is second rotor shaft bearing, 18 is second rotor shaft, 19 is shaft support, 20 is space within first rotor, 21 is casing aperture into which a vacuum pump may be connected, 22 is cooling heat exchanger, 23 is a layer of thermal insulation, 24 is heat exchanger support plate, 25 is coolant distribution conduit, 26 is working fluid entry to first rotor, 27 and 28 are coolant entry and exit, 29 is first rotor shaft supported by bearing 30, 31 is working fluid entry to unit, 32 is rotor seal, 36 is vane within first rotor. 35 is a seal.

Figure 2:
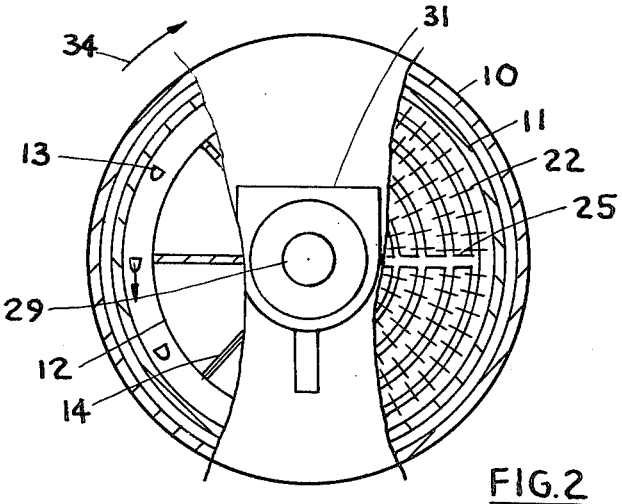
FIG. 2 is an end view of the same unit with portions removed to show internal details.

In FIG. 2, an end view of the unit shown in FIG. 1 is illustrated with portions removed to show interior details. 10 is casing, 11 is first rotor, 22 is is heat exchanger, 25 is coolant distribution conduit, 14 is second rotor vane, 12 is second rotor, 29 is shaft, 13 are nozzles, 34 indicates direction of rotation for both rotors. 31 is fluid entry.

Figure 3:
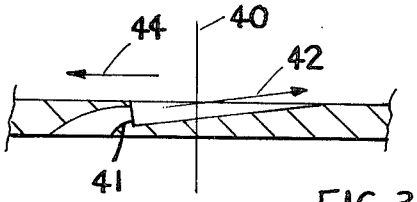
FIG. 3 is a detail of the nozzles employed within first rotor.

In FIG. 3, a detail of the first rotor nozzles is shown. 40 is shaft direction about which rotor rotates, 44 is direction of rotation, 41 is nozzle, and 42 indicates leaving fluid.

In operation, the working fluid enters unit via opening 31 and is passed to first rotor via entry post 26, and then said working fluid passes to rotor interior where vanes 36 and heat exchanger 22 will assure that said working fluid will rotate with said rotor. After compression, said working fluid leaves said first rotor via nozzles 13 or more particularly as indicated in FIG. 3 by numerals 41, 42; these nozzles are oriented to discharge said working fluid backward, thus reducing the absolute tangential velocity of said fluid. Said fluid then enters said second rotor 12, where vanes 14 by virtue of the working fluid acting thereagainst will assure that said rotor will rotate with said working fluid; said working fluid is then discharged from said second rotor via exit port 17, and from the unit via opening 16.

Cooling may be applied to said working fluid during compression, by circulating a coolant through said heat exchanger 22, in heat exchange relationship with said working fluid. Coolant enters via entry 27 and thence through said first rotor shaft passages, and leaves via passages through said first rotor shaft to exit through exit 28.

Work is required to accelerate said working fluid to the tangential speed of said first rotor; power is supplied to the shaft of said first rotor. Some work is returned to said first rotor in nozzles 13, and additional work is produced by the decelerating working fluid in second rotor passages. Normally, the rotational speed of said second rotor is less than said first rotor. Also, in normal operation, the rotational speed of said first rotor is sufficient to provide for a substantial exit velocity for said working fluid from said rotor nozzles 13; then also, the rotational speed of said second rotor is substantially less than said rotational speed of said first rotor. The difference in speeds for the two rotors is normally fixed and the two rotors are connected by suitable external power transmission means to pass the work produced by said second rotor to said first rotor, with additional work for rotating said first rotor being provided from an external power source.

If the cooling heat exchanger is not provided, then the vanes 36 are extended to the periphery of said first rotor to assure that said working fluid will rotate with said first rotor.

The first rotor is shown in FIG. 1 to have been extended to inclose said second rotor, with seals 35 and 15 providing sealing to maintain working fluid pressure within rotor and to seal with casing. Space 20, FIG. 1, is provided to allow working fluid leaving nozzles 13 to move and adjust to second rotor tip speed. It should be noted that usually the absolute working fluid tangential velocity when entering said second rotor is the same as the tip speed of said second rotor, for best efficiency.

Applications of this compressor include use as an air compressor, as a compressor for various gases, and as a refrigeration compressor and heat pump compressor. Also, it can be used as the compression stage in power generation devices.

Various governors and controls are used with this compressor. They do not form a part of this invention and are not further described herein.

The rotors for the compressor of this invention are shaped to allow high rotational speeds, with rotor walls made of thick material sections and generally having thick center sections. The heat exchanger is made of finned tubing attached to a support plate to prevent movement and crushing; said support plate is then supported by said rotor walls. Other types of heat exchanger construction may be employed, such having coolant passages built to rotor walls. Also, the vanes 14 of said second rotor may be made with suitable curvature if said working fluid tangential velocity should differ from the second rotor tangential tip velocity.

The radial velocity of the working fluid within the radially extending passageways of both rotors is normally slow, so that the compression within said first rotor is nearly non-flow type, and the expansion within said second rotor is nearly non-flow type. Thus the compression within said first rotor is similar to compression within a centrifuge rotor.

What is claimed is:

1. A working fluid compressor expander comprising:

a. a casing for supporting shafts;

b. shafts journalled in bearings in said casing for rotation;

c. a rotating first rotor mounted on a first rotor shaft so as to rotate in unison therewith, said rotor being of circular cross section in a radial plane and adapted for high speed rotation with its structural walls being thicker near the center than at its periphery; said rotor having an entry port for said working fluid near the center of said rotor and radially extending passageways having vanes therewithin for assuring that said working fluid therewithin rotates at the same rotational speed as said rotor for effecting centrifugal compression and effecting an elevated pressure at its periphery a cooling heat exchanger within said radially extending passageways in said first rotor with a coolant being circulated through passages within said heat exchanger in heat exchange relationship with said working fluid for the purpose of removing heat from said working fluid; said coolant being supplied to said heat exchanger via passages provided through said first rotor shaft, and returned via passages within said first rotor shaft; nozzles communicating at their entry end with said radially extending passageways and discharging said working fluid to a peripheral portion within said rotor; with said peripheral portion being separated from said radially extending passage ways by a wall with said nozzles mounted on said wall;

d. a rotating second rotor mounted on a second rotor shaft so as to rotate in unison therewith, said second rotor being of circular configuration in a radial plane and adapted for high speed rotation; said rotor having radially extending passageways communicating with said peripheral portion of said first rotor for receiving said working fluid; said radially extending passageways extending inwardly toward the center of said rotor, and having vanes therewithin to cause rotation of said second rotor on impingement by said working fluid against said vanes; and having an exit port near the center of said second rotor.

2. The compressor of claim 1 wherein said nozzles mounted within said first rotor are oriented to discharge said working fluid tangentially backward in a direction away from the direction of rotation of said first rotor thus reducing the absolute tangential velocity of said working fluid.

3. The compressor of claim 1 wherein said casing is provided with an aperture for evacuating a space between said first rotor and said casing for reducing fluid friction on said first rotor.

4. The compressor of claim 1 wherein the tangential velocity of the second rotor outer periphery is less than the tangential velocity of the nozzles mounted on said first rotor.

5. The compressor of claim 1 wherein the tangential velocity of the outward ends of the second rotor vanes is the same as the tangential velocity of the working fluid entering said radially inward extending passageways of said second rotor.

6. The compressor of claim 1 wherein the tangential velocity of the outward ends of the second rotor vanes is less than the tangential velocity of the working fluid entering said radially inward extending passageways of said second rotor.

7. The compressor of claim 1 wherein said working fluid is a gas with minor amounts of liquid, if any.

* * * * *